United States Patent [19]

Smith

[11] Patent Number: 4,708,686

[45] Date of Patent: Nov. 24, 1987

[54] ECCENTRICALLY WEIGHTED ROLLING DEVICE RETURNS UPHILL

[76] Inventor: Samuel C. Smith, 210 Hartman Rd., Newton Centre, Mass. 02159

[21] Appl. No.: 542,681

[22] Filed: Oct. 17, 1983

Related U.S. Application Data

[63] Continuation-in-part of Ser. No. 351,114, Feb. 22, 1982, Pat. No. 4,411,096.

[51] Int. Cl.[4] ..... A63H 29/10

[52] U.S. Cl. ..... 446/166; 446/167; 446/267; 446/458

[58] Field of Search ..... 446/166, 167, 171, 174, 446/168, 267, 396, 431, 443, 444, 442, 458, 465, 491, 273, 325, 324; 272/8 R, 8 N; 236/52; 434/300, 302, 446

[56] References Cited

U.S. PATENT DOCUMENTS

| | | | |
|---|---|---|---|
| 2,100,372 | 11/1937 | Barton | 446/167 |
| 2,499,743 | 3/1950 | Goodman | 446/325 |
| 2,585,780 | 2/1952 | Johnson | 446/396 |
| 3,564,733 | 2/1971 | Field et al. | 446/166 X |
| 4,205,483 | 6/1980 | Clark et al. | 446/167 |

FOREIGN PATENT DOCUMENTS

| | | | |
|---|---|---|---|
| 555328 | 6/1923 | France | 446/458 |
| 1442582 | 7/1976 | United Kingdom | 446/458 |

*Primary Examiner*—Mickey Yu
*Attorney, Agent, or Firm*—Donald W. Meeker

[57] ABSTRACT

A sealed container with a movable weight therein is eccentrically mounted within a light rollable object on a guideway. Liquid mercury, powered metal, or metal pellets or spheres would move within the container to shift the center of gravity. Maintaining the center of gravity of the weight to the uphill side of a vertical extension of the tangent between the rolling object and the guideway will enable the rolling object to return uphill after rolling down within a limit, thereby seeming to defy the law of gravity.

19 Claims, 6 Drawing Figures

ECCENTRICALLY WEIGHTED ROLLING DEVICE RETURNS UPHILL

CROSS-REFERENCE TO RELATED APPLICATION

This is a continuation-in-part of application Ser. No. 06/351,114, filed 02/22/82 (U.S. Pat. No. 4,411,096 to issue on 10/25/83).

This application defines alternate methods of utilizing the weight of the previous application and points out some specifics in the form of a new weight means which, heretofore, had not been mentioned.

In this regard, we are calling for a module in the form of a sealed container partially filled with liquid weight such as mercury. It is preferred that the module, available in different sizes, be circular at its periphery. Thus, it will conveniently fit on the inner periphery of a cylindrical ring or cylinder. The partially filled container, combined with an inherent baffle—due to the curvature (or circular form) of the container—provides a device with a constant weight but shifting center of gravity. The effect is to increase the torque thereby causing a rolling body, to which the device is attached, to travel an unusually long upward distance (from a lower position on a sloping surface). In the interest of economy and standardization, the variety of size and shape of the module can be reduced to a minimum. In effect, a certain type can be employed in any of a large variety of cylindrical bodies and another certain type can be fitted in any of a large variety of spherical bodies. Be it a head, a wheel or any type of spherical or cylindrical body, an appropriate module can be readily procured to attach to the body for return rolling to its normal at rest position.

Still another type of module resides in the shape of the base of a test tube. Such type is particularly suited for the neck of heads where the neck is to enter a corresponding recess for its stable resting position. A version of the return uphill invention lies in the application of an (module bearing) object climbing a hill without the aid of an outside force, nor does it contain winding spring or motor devices. In practice, the object, in this case a wheel, is camouflaged to give the appearance of a vehicle. A guide on each side of the wheel—fastened to the inclined surface—keeps the wheel on a straight path. Good coefficient of friction between the wheel and plane surfaces is a requirement.

The distance of climb is a function of the weight, the length of the circumference of the wheel (or cylinder), total weight of apparatus and the slope of the inclined plane. It is desirable to use light materials for the wheel so that the center of gravity of the wheel need not be considered. For optimum results, the carriage or anything carried by the wheel should also be of light materials.

Figure 1:
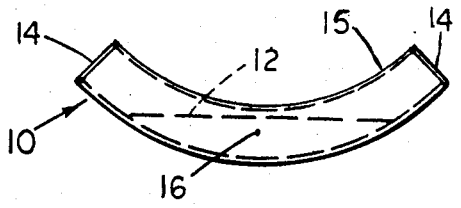
FIG. 1 is a view in front elevation of a module or container with sealed liquid weight.

Turning now to the details of the FIGURES:

Module 10 in FIG. 1 is shown partially filled with liquid weight 12. The filling operation may be accomplished through one end 14 before sealing same. The center of gravity (c.g.) in this position is indicated.

Figure 2:
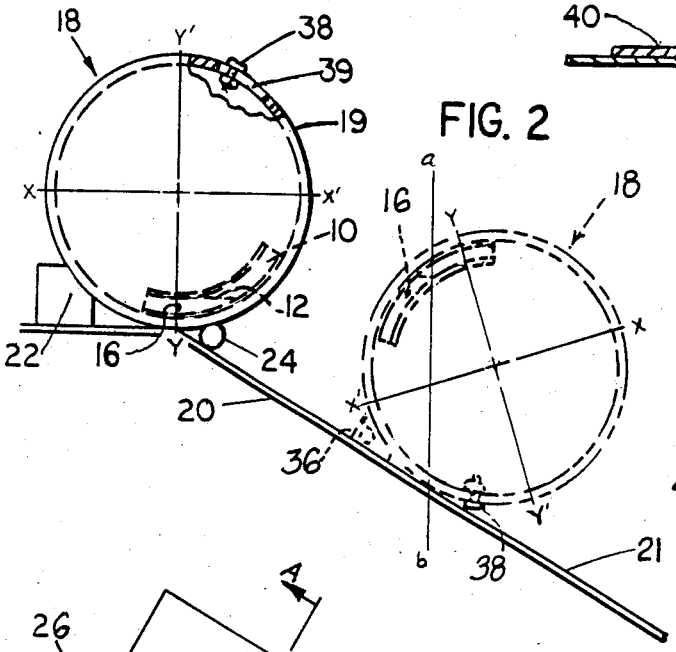
FIG. 2 shows an elevation view in partial section of a module bearing cylinder or wheel, first in a resting position at the top of an incline, then down the incline (dashed lines) at a point where it is ready to climb back.

In FIG. 2, a hollow cylinder 18 has a weight module attached to its inner periphery in a manner that allows the vertical axis y-y of the cylinder to pass through a point considerably less than ½ the length of the module when in the at-rest position. The level of the liquid weight 12 and the center of gravity 16 are indicated in this position. After the cylinder rolls down an inclined plane 20, to another position down hill (dashed lines), the c.g. of the weight module shifts counter to the downward rolling of the cylinder and causing a longer travel (as compared to a rigid weight with a constant c.g.) before reversing travel direction toward uphill. Note position of the c.g. with respect to the liquid weight at this point. Note also, position of c.g. in relation to a vertical line a-b. This relationship is a key point in that regardless of the slope of the incline (barring a frictionless surface), as long as the c.g. is to the left (uphill side) of a vertical line passing through the common point of tangency of the cylinder and plane, the rolling object (or cylinder) will always return uphill by virtue of the force of gravity acting upon the eccentric weight module. The cylinder in FIG. 2 is returnable to its starting position because the c.g. of the module is left of the line ab. In fact, the cylinder could have been allowed to roll down farther.

A shock absorber 22 (sponge rubber with adequate resiliency) absorbs shock of the cylinder as it reaches the top of the incline 20 and a section of thin-walled rubber tubing 24, secured transversely across the top of the incline, ensures seating position of cylinder 18 following bouncing effect of the shock absorber. The tubing collapses with slight pressure and therefore does not materially affect pure rolling of the cylinder or wheel.

Figure 4:
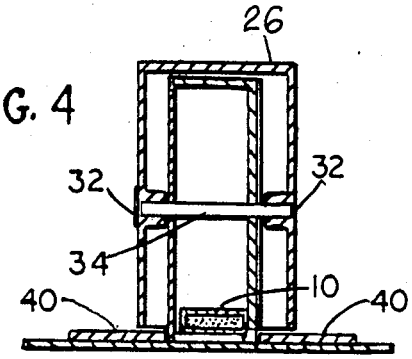
FIG. 4 shows a sectional front view of the vehicle taken through 4—4 of FIG. 3 and the weighted wheel interconnects with the vehicle body.
Figure 3:
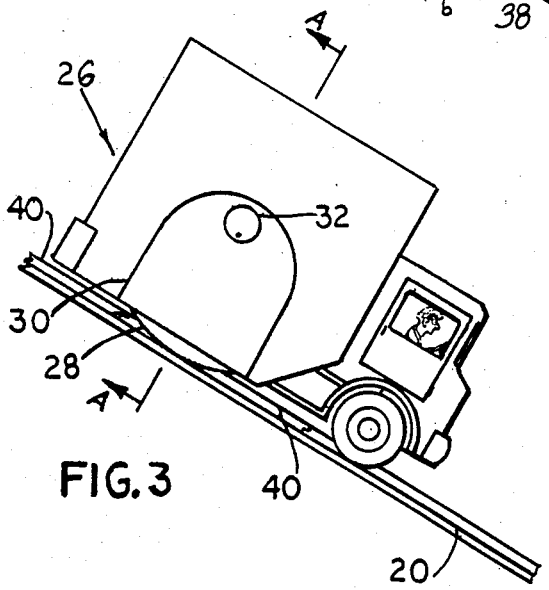
FIG. 3 shows a side elevation view of a practical application of the invention in the body of a vehicle.
Figure 6:
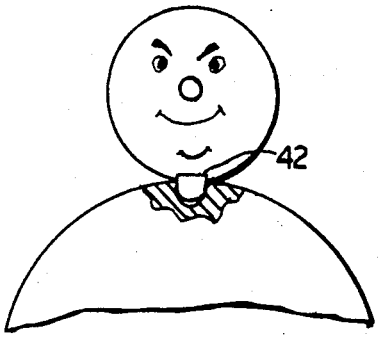
FIG. 6 shows a partial assembly of a head and body with the neck module of FIG. 5.

Vehicle 26 in FIG. 3 shows one practical utilization of the invention. Tire wheel 28, an extension of cylinder 18, appears instead to be a wheel of a much smaller diameter. Wheel cover 30 further accents the apparent smallness of wheel 28. A plate 32 rotates to render access to shaft 34 in FIG. 4 for assembling and disassembling purposes. A pair of guides 40 attached to the plane on the sides of the cylinder or wheel keep the object on a straight course.

Figure 5:
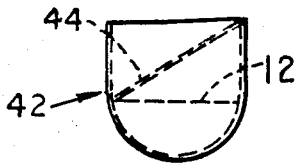
FIG. 5 is an elevation view of a module intended for use on doll type or head rolling on body type objects.

Module 42 in FIG. 5, an alternate embodiment of the module designed for head rolling over body function, contains an ovally-shaped baffle 44 angularly covering the liquid weight within a capsule having a hemispherical bottom. As the object rolls clockwise, the baffle directs the bulk of the liquid weight to the left, thereby increasing the length of travel of the object since the center of gravity is accordingly shifted to the left. Not as readily seen is the baffle of module 10, inherent in the form of the module as seen in FIG. 1. For instance, the extended minor diameter wall 15 of module 10 is a barrier which causes the liquid weight to concentrate on the left as the object rotates clockwise. Similarly, the slope of cover or baffle 44 in FIG. 5 constrains the position of the liquid weight to the left in the module 42 as the object rotates clockwise.

The object may be made to roll down and immediately released for returning or it may be kept in the down position for release at a later time. Wedge 36, placed on the inclined plane uphill of the cylinder, (or other retaining means) is provided for this retaining purpose.

Adjustable screw and nut 38 secured through the cylinder wall act as a limit step and prevent the cylinder from rolling down beyond its self-returnable point. Slot 39 allows for adjustable of the limit stop by moving the adjustable screw within the slot. Either or both surfaces 19 of the cylinder 18 and 21 of the incline 20 should be rough or contain a high coefficient of friction.

Although a liquid weight is preferred, metals, in other form—powder, pellets, balls—may also be used. In effect, any substance that will shift within the module is applicable.

The apparent phenomenon of the invention seems to defy the law of gravity but in fact follows established Laws of Physics and with the teaching provided here, the number of creations that can emanate is limited by one's imagination.

One example:

In the course of conducting laboratory tests, a young scientist implements a safety apparatus which he devised. Should loss of power occur causing a breakdown in continuity of a test, a wheel, magnetically held, is released and rolled to a point where it strikes a switch triggering an auxiliary power source. Just as soon as the outage is rectified, the wheel is released from the magnet on the auxiliary power source side and return to its normal position in readiness for the next power failure.

Later, in preparation for a more crucial experiment for his High School project, the young scientist modified his lab apparatus to include a recording of the few elapsed seconds between the main power loss and the start-up of auxiliary power. He also included means of sounding a warning alarm.

Having thus described my invention, what I claim as new and desire to secure by Letters Patent of the United States is:

1. A gravity actuated return motion rolling device comprising:

a rollable object generally curved convexly on an exterior rolling surface, which rollable object is of light weight;

eccentrically positioned relative to the center of gravity within the rollable object, a relatively heavyweight secured adjacent to an edge of the rolling surface;

a guideway exterior to the rolling object, along which guideway the rolling object is free to roll within a controlled limit;

wherein the rolling object is positioned at rest with the eccentric weight oriented so that when the object is rolled along the guideway within the limit, the eccentric weight will produce a torque in the rolling object to return the rolling object back over the guideway to its original rest position wherein the weight comprises an enclosed container with a movable heavy mass of material contained therein, wherein the container is secured in close proximity to the rolling surface with the center of gravity of the mass within the container located away from the center of gravity of the rollable object, and wherein the weight protrudes beyond the rolling surface and the guideway further comprises an opening therein to receive the protruding weight in the at rest position.

2. A gravity-actuated traveling return motion rolling device comprising:

a rollable traveling object generally curved convexly on an exterior rolling surface, which rollable object is of light weight;

eccentrically positioned relative to the center of gravity within the rollable object, a relatively heavy weight secured adjacent to an edge of the rolling surface;

an inclined guideway exterior to the rolling object, along which guideway the rolling object is free to roll within a controlled limit; wherein the rolling object is positioned at rest with the eccentric weight oriented so that when the object is rolled along the guideway within the limit of travel, the eccentric weight will produce a torque in the rolling object to return the rolling object automatically back over the inclined guideway to its original rest position wherein the weight comprises an enclosed container with a flowable heavy mass of material contained therein, wherein the container is secured in close proximity to the rolling surface with the center of gravity of the mass within the container located away from the center of gravity of the rollable object, and wherein the container further comprises a curved surface which provides a baffle effect for the flowable mass of material and the container is positioned adjacent to the exterior rolling surface and wherein the weight protrudes beyond the rolling surface and the guideway further comprises an opening therein to receive the protruding weight in the at rest position.

3. A gravity-actuated traveling return motion rolling device comprising:

a rollable traveling object generally curved convexly on an exterior rolling surface, which rollable object is of light weight;

eccentrically positioned relative to the center of gravity within the rollable object, a relatively heavy weight secured adjacent to an edge of the rolling surface;

an inclined guideway exterior to the rolling object, along which guideway the rolling object is free to roll within a controlled limit;

wherein the rolling object is positioned at rest with the eccentric weight oriented so that when the object is rolled along the guideway within the limit of travel, the eccentric weight will produce a torque in the rolling object to return the rolling object automatically back over the inclined guideway to its original rest position wherein the weight comprises an enclosed container with a flowable heavy mass of material contained therein, wherein the container is secured in close proximity to the rolling surface with the center of gravity of the mass within the container located away from the center of gravity of the rollable object; and wherein the container further comprises a curved surface which provides a baffle effect for the flowable mass of material and the container is positioned adjacent to the exterior rolling surface.

4. The invention of claim 3 wherein the container is sealed and the heavy mass comprises a quantity of liquid mercury flowing with the sealed container.

5. The invention of claim 3 wherein the container is sealed and the movable mass comprises a metallic powder drifting within the sealed container.

6. The invention of claim 3 wherein the movable mass comprises metallic pellets moving within the container.

7. The invention of claim 6 wherein the pellets are spheroid and roll within the container.

8. The invention of claim 3 wherein the container further comprises baffles within the container to regulate the movement of the mass within the container.

9. The invention of claim 3 further comprising a deformable protrusion means on the guideway to retain the rolling object in the at rest position.

10. The invention of claim 3 wherein the guideway comprises an inclined plane and the limit of rolling is a distance which stops the downward movement of the rollable object with the center of gravity of the weight positioned away from and located uphill of the center of gravity of the rollable object so that the weight causes the rollable object to roll back up the inclined plane.

11. The invention of claim 3 wherein the guideway comprises a vertically curved surface of variable downward slope and the limit of rolling is a distance which stops the downward movement of the rollable object with the center of gravity of the weight positioned away from the center of gravity of the movable object in a direction from which the object rolled so that the weight causes the rollable object to roll back up the curved surface.

12. The invention of claim 3 wherein the guideway is further provided with a protrusion therefrom which acts to limit the extent of rolling.

13. The invention of claim 3 wherein the exterior rolling surface is further provided with a protrusion therefrom which acts to limit the extent of rolling.

14. The invention of claim 3 further comprising means adjacent the guideway for preventing diversion of the rolling surface from the guideway.

15. The invention of claim 3 further comprising means on the guideway surface to prevent slippage between the rolling surface and the guideway.

16. The invention of claim 3 further comprising means on the rolling surface to prevent slippage between the rolling surface and the guideway.

17. The invention of claim 3 further comprising a removable protrusion means on the guideway to retain the rolling object at the limit of its roll.

18. A gravity actuated return motion rolling device comprising:

a rollable object generally curved convexly on an exterior rolling surface, which rollable object is of light weight;

eccentrically positioned relative to the center of gravity within the rollable object, a relatively heavy weight secured adjacent to an edge of the surface;

a guideway exterior to the rolling object, along which guideway the rolling object is free to roll within a controlled limit;

wherein the rolling object is positioned at rest with the eccentric weight oriented so that when the object is rolled along the guideway within the limit, the eccentric weight will produce a torque in the rolling object to return the rolling object back over the guideway to its original rest position; and wherein said rolling device constitutes an educational toy and further comprising a vehicle body, within which the rollable object comprises a large wheel rotatably mounted in a hidden position centrally within the vehicle body and the guideway comprises an inclined plane resembling a road down which road the vehicle is rolled and then backs up the road in apparent defiance of gravity.

19. The invention of claim 18 wherein the container is formed in a curved shape so that the curvature of the container acts as baffle for the movable mass within the container.

* * * * *